US008934210B1

(12) United States Patent
Denis et al.

(10) Patent No.: US 8,934,210 B1
(45) Date of Patent: Jan. 13, 2015

(54) DEMAGNETIZATION USING A DETERMINED ESTIMATED MAGNETIC STATE

(75) Inventors: Ronald J. Denis, Camas, WA (US); Nathanael J. Makowski, Vancouver, WA (US)

(73) Assignee: U.S. Department of Energy, Washington, DC (US)

( * ) Notice: Subject to any disclaimer, the term of this patent is extended or adjusted under 35 U.S.C. 154(b) by 282 days.

(21) Appl. No.: 13/535,637

(22) Filed: Jun. 28, 2012

(51) Int. Cl.
*H01F 1/00* (2006.01)

(52) U.S. Cl.
USPC ..... 361/149

(58) Field of Classification Search
USPC ..... 361/143, 149
See application file for complete search history.

(56) References Cited

U.S. PATENT DOCUMENTS 6,160,697 A * 12/2000 Edel ..... 361/143
6,479,976 B1 * 11/2002 Edel ..... 323/357
6,522,517 B1 * 2/2003 Edel ..... 361/143
2001/0053084 A1 * 12/2001 Navas Sabater et al. .. 363/21.02
2012/0218782 A1 * 8/2012 Bodkin et al. ..... 363/13
2013/0094117 A1 * 4/2013 Metala et al. ..... 361/267

* cited by examiner

*Primary Examiner* — Rexford Barnie
*Assistant Examiner* — Angela Brooks
(74) *Attorney, Agent, or Firm* — Michael J. Dobbs; Daniel D. Park; John T. Lucas

(57) ABSTRACT

A method for demagnetizing comprising positioning a core within the electromagnetic field generated by a first winding until the generated first electrical current is not substantially increasing, thereby determining a saturation current. A second voltage, having the opposite polarity, is then applied across the first winding until the generated second electrical current is approximately equal to the magnitude of the determined saturation current. The maximum magnetic flux within the core is then determined using the voltage across said first winding and the second current. A third voltage, having the opposite polarity, is then applied across the first winding until the core has a magnetic flux equal to approximately half of the determined maximum magnetic flux within the core.

21 Claims, 8 Drawing Sheets

DEMAGNETIZATION USING A DETERMINED ESTIMATED MAGNETIC STATE

GOVERNMENT INTERESTS

The United States Government has rights in this invention pursuant to the employer-employee relationship between the U.S. Department of Energy (DOE) and the inventors at the Bonneville Power Administration.

CROSS-REFERENCE TO RELATED APPLICATIONS

Field of the Invention

The present invention relates to the demagnetization of a material exhibiting magnetic hysteresis, preferably a core of a transformer.

BACKGROUND OF THE INVENTION

High-voltage, power transformers are essential to modern day power systems. The expense of a network transformer (a transmission class high voltage power transformer) is such that even a single loss can be a significant financial burden. Additionally, power transformer failure causes electrical outages, resulting in possible economic disasters. A failure may also damage equipment connected to the transformer, further increasing the economic impact. Therefore, it is recommended that the condition of power transformers be routinely checked, preferably including the use of a resistance test. This allows an electric distribution entity to minimize failures, while also minimizing cost. A necessary but ultimately undesirable consequence of testing is residual magnetization. If the transformer is left magnetized, it will increase peak electrical currents, leading to damage of electronic components in the system. Therefore, there is a need to quickly and reliably demagnetize transformers, preferably while also testing the health of the transformer.

SUMMARY OF THE INVENTION

One method for demagnetizing comprises providing a core. The core is positioned within the electromagnetic field generated by a first winding upon application of a first voltage across the first winding. The first voltage is applied across the first winding generating a first electrical current through the first winding until the generated first electrical current is not substantially increasing, thereby determining a saturation current.

After applying the first voltage across the first winding, a second voltage is applied across the first winding generating a second electrical current through the first winding until the generated second electrical current is approximately equal to the magnitude of the determined saturation current. The polarity of the second voltage is opposite of the polarity of the first voltage. During the application of the second voltage across the first winding, a value related to the maximum magnetic flux within the core is determined, preferably by a processor, using a value relating to the voltage across the first winding and a value relating to the second current.

After applying the second voltage across the first winding, applying a third voltage across the first winding generating a third electrical current through the first winding until the core has a value related to the magnetic flux, the same relation as the determined value related to the maximum magnetic flux, equal to approximately half of the determined value related to the maximum magnetic flux within the core. The polarity of the third voltage is opposite of the polarity of the second voltage.

In a preferred embodiment, the electrical resistance across the first winding is determined from the voltage across the first winding and the first electrical current and health characteristics are determined for the core using a predetermined dataset corresponding to the core. Preferably, Ohm's law is used to calculate the resistance of the first winding from the voltage across the first winding divided by the electrical current through the first winding. Preferably, the first voltage is used as the voltage across the first winding when calculating the electrical resistance of the first winding. More preferably, the voltage across the first winding when calculating the electrical resistance of the first winding is measured directly using a volt meter.

In one embodiment, the flux linkage of the first winding is used to estimate the magnetic flux within the core. In a preferred embodiment of using the flux linkage of the first winding to estimate the magnetic flux within the core, the step of determining a value related to the maximum magnetic flux within the core comprises measuring the electrical current through the first winding during the application of the second voltage and calculating a value related to the integral of the voltage across the first winding with respect to time minus a value related to the integral of the product of the winding resistance and the electrical current through the first winding with respect to time, thereby determining a value related to the maximum magnetic flux. In this embodiment, the step of applying a third voltage across the first winding comprises calculating a value related to the integral of the voltage across the first winding with respect to time minus a value related to the integral of the product of the winding resistance and the electrical current through the first winding with respect to time, thereby determining a value related to the magnetic flux of the core. In a preferred embodiment, the voltage across the first winding during the application of the second voltage is measured directly using a volt meter. In an alternative embodiment, the voltage across the first winding is determined from the second voltage, more preferably it is the second voltage. Preferably, the value related to an integral, either calculated precisely or including various mathematical estimations, simplifications, approximations, or combinations thereof. Preferably, all calculations are performed by a processor, for example a CPU (Central Processing Unit), microcontroller, ASIC (Application Specific Integrated Circuit) or combination thereof.

In a preferred embodiment, the step of determining a value related to the maximum magnetic flux within the core comprises multiplying the determined saturation current by approximately 0.6, more preferably 0.632, determining a two-tau saturation current. In this embodiment, during the step of applying a second voltage across the first winding, the amount of time for the second electrical current to reach the approximate magnitude of the two-tau saturation current is timed, thereby determining the saturation time. The half saturation time is determined by dividing the timed two-tau saturation time by two. In this embodiment, the third voltage is applied across the first winding for the determined half saturation time. Preferably, all calculations are performed by processor, for example a CPU (Central Processing Unit), microcontroller, ASIC (Application Specific Integrated Circuit) or combination thereof.

DETAILED DESCRIPTION OF THE INVENTION

Figure 1:
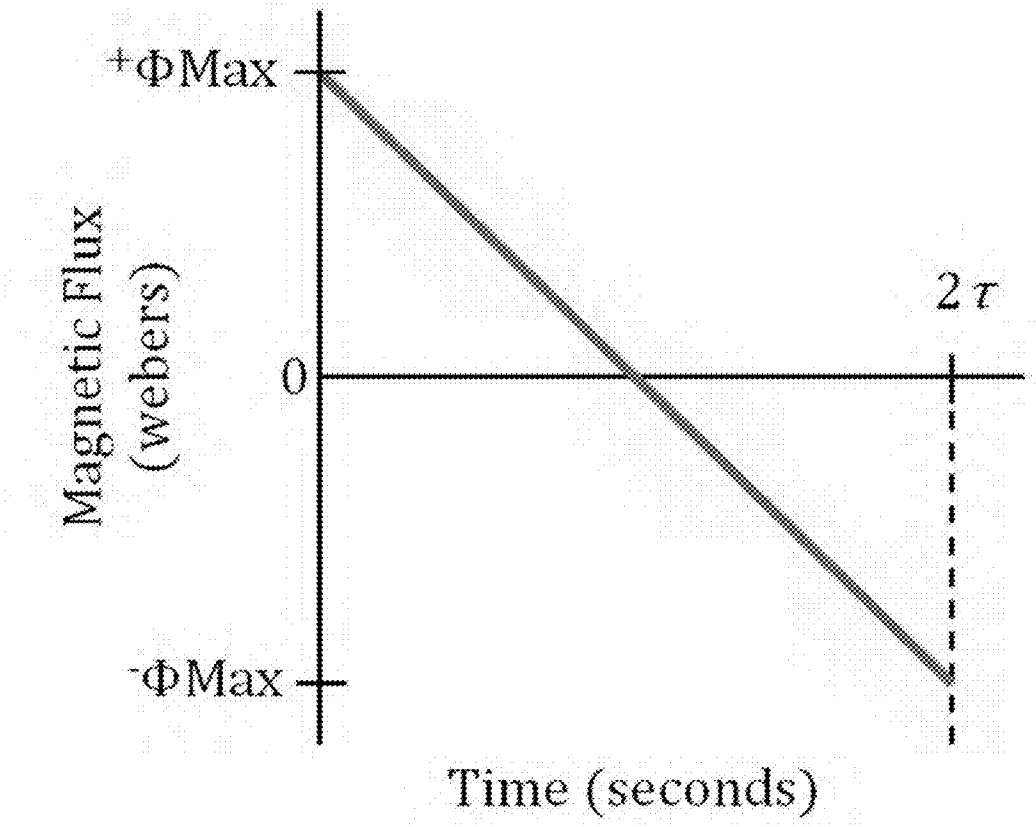
FIG. 1. depicts a magnetization as a function of time, given a fixed voltage across transformer winding.

While the magnetic flux density in a core is not directly measurable, for practical purposes the magnetic flux linkage can be useful for determining the magnetic state of the core. By Faraday's law, the magnetic flux linkage is:

$$N\Phi=\int V_L dt \tag{1}$$

Although the flux linkage may be obtained in real-time by integrating the voltage drop due to inductance, it is convenient to simplify the relationship thereby minimizing the load on the processing system. Since only the state of the core is of interest, we can assume that any flux linkage generated beyond the saturation of the core is not relevant. When a DC voltage is applied and winding resistance loss is negligible, this allows the simplification of (1) to:

$$\Delta\Phi\propto\Delta t \tag{2}$$

An iterative process revealed that by measuring the time it takes for the current to reach 63% of the steady state current when measured from reverse saturation after the applied voltage has been reversed gives the appropriate Δt for the given assumptions.

These results were consistent with analysis of (1) where the voltage across the inductance is approximated as an exponentially decaying function with respect to time:

$$N\Phi=\int_0^\infty V_{L(t=0)}e^{-t/\tau}dt=\tau VL(t=0) \tag{3}$$

Where τ is measured as time needed for the current to reach 63.2% of its steady state (saturated) magnitude. A prototype device was constructed in order to demonstrate that the demagnetization could be performed automatically. This prototype test set also automatically measures the winding resistance. An embedded computer controls the process for saturating the core by applying a DC voltage and subsequently performs the demagnetization by first characterizing the total change in magnetic flux when driven from magnetic saturation to the reverse magnetic saturation, this is represented by time needed to reach 63.2% of steady state current magnitude (approximately two time constants). After that, it applies a fixed voltage from a saturated state for half of that time leaving the core in a magnetically neutral (demagnetized) state.

The accuracy of demagnetization was evaluated by three methods: First, by measuring the time needed to reach 90% of steady state current after the demagnetization process with both positive and negative magnetization directions. Second, by recording the voltage across and current through the transformer, the flux linkage (V*s) can be calculated taking in to account the losses due to wire resistance. Third, by solving (3) for one half-cycle of a transformer's 60 Hz rated voltage, the operating flux linkage of the transformer can be obtained. For most transformers, designed to operate within some small percentage of saturation, the flux linkage of the demagnetization cycle can be estimated with reasonable accuracy.

The first method was performed multiple times on a variety of single phase transformers with voltage classes ranging between 34.4-kV to 345-kV. This method resulted in a standard deviation of 1-3% from the overall average and an average flux linkage (V*s) of V*s of 129 and a demagnetization error of 4.3%.

In the second method voltage across the inductance was integrated from saturation to reverse saturation then compared with the integration from saturation to the expected demagnetized point. Once calculated from the characterization step as an expected flux linkage (V*s) of 135, the flux linkage of the demagnetization step of the procedure differed by 1% from the expected flux linkage determined from characterization step.

Figure 2:
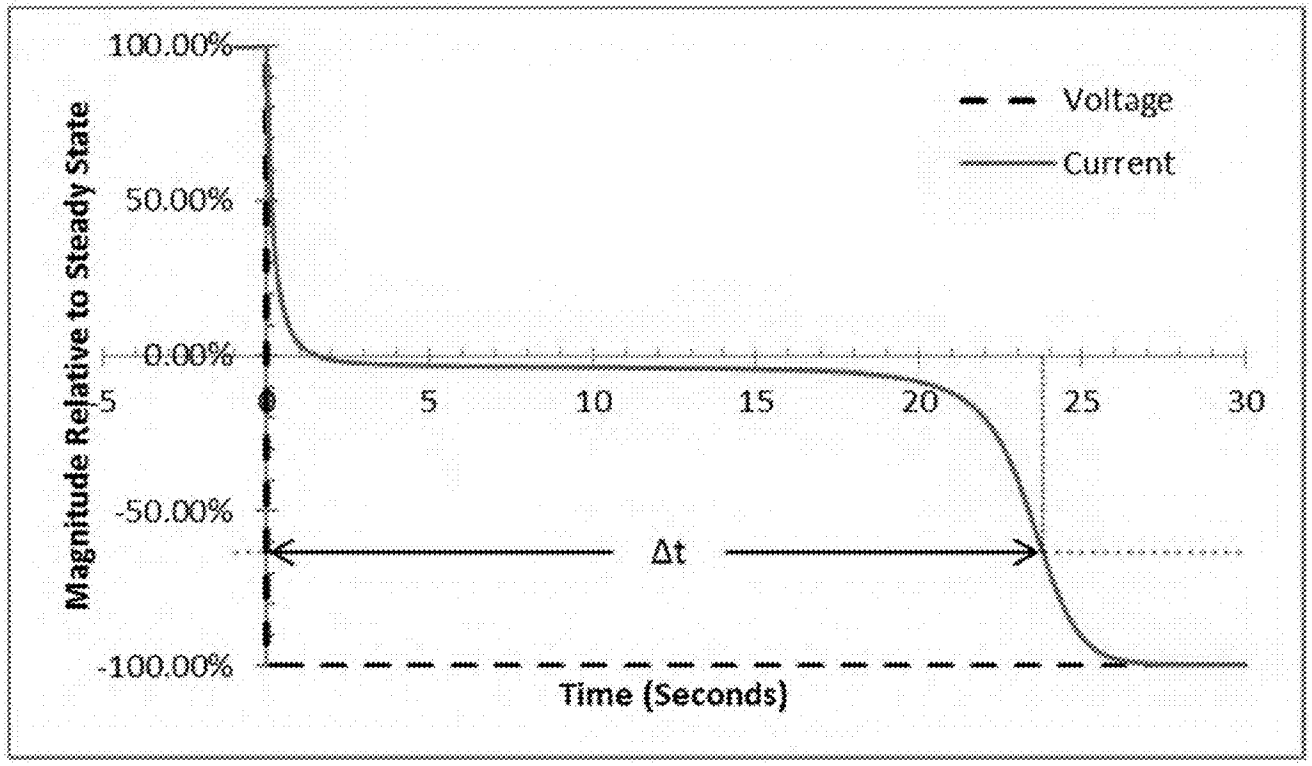
FIG. 2 depicts the voltage and current waveforms of a transformer winding during the measurement of flux linkage. At t=0 the transformer core is saturated and the current has reached its resistive limit. At t=0 the voltage polarity is reversed.

The third method also produced results as were expected. For example, for the 34.4-kV transformer, one half cycle of rated voltage at 60 Hz produces a flux linkage (V*s) of 129 and a demagnetization error of 4.3%. The flux linkage characterization step for the transformer is shown in FIG. 2. When integrated from 0 to the 30 second mark and divided by two, the flux linkage was found to be 135 V·s. Finally, when the prototype test set performed the demagnetization for the time determined from the characterization step, the measured flux linkage over that interval was 137 V·s.

FIG. 3

Figure 3:
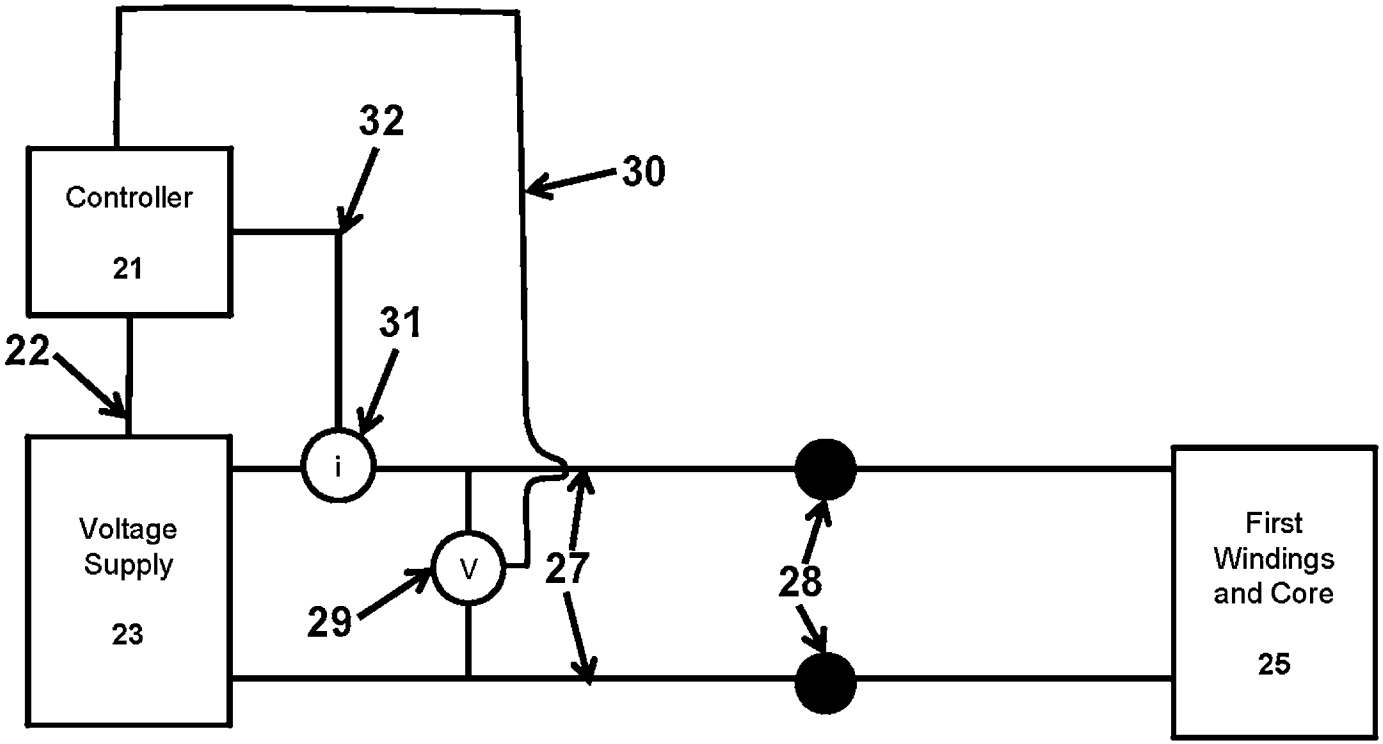
FIG. 3 depicts one embodiment of a device for demagnetizing.

FIG. 3 depicts one embodiment of a device for demagnetizing. As shown, a controller 21 is connected to a voltage supply 23, preferably via one or more wires 22. The voltage supply 23 is electrically connected via one or more wires 27 to the first winding electromagnetically connected to a core 25. A volt meter 29 is electrically connected via the one or more wires 27 across the first winding 25. The volt meter 29 is also connected to the controller 21 and provides a signal related to the voltage across the first winding 25. A current meter 31 is electrically connected to one of the wires 27 between the voltage supply 23 and the first winding 25. The current meter 31 is also connected to the controller 21 and provides a signal related to the electrical current running through the first winding 25. Preferably, the first winding 25 is connected to the voltage supply 23 via a first winding connector 28. In this embodiment, the current meter 31 is positioned between the voltage supply 23 and the first winding connector 28. In an alternative embodiment, the first winding connector 28 is omitted. The first winding connector 28 is any means of electrically connecting the voltage supply 23 to the first winding 25 as described above, preferably a metal connection, for example a clamp, screw or pressure fit connection.

The controller 21 is any means of controlling the voltage supply 23 based on data from the volt meter 29 and the current meter 31. Preferably, the controller 21 is a processor, for example CPU (Central Processing Unit), microcontroller or ASIC (Application Specific Integrated Circuit). The controller 21 is configured to perform at least the demagnetization method described herein, preferably by storing a series of machine instructions of at least the demagnetization method herein in memory (e.g. ROM, Flash Memory, Magnetic Media, etc.). The controller preferably comprises an ALU (Arithmetic Logic Unit) capable of division and multiplying. The controller 21 preferably also comprises a timer, preferably a clock built into the controller 21 or in the alternative an external timer, for example the 555 Timer, triggering a counter within the controller 21. In one embodiment, the controller 21 comprises an HC11 microcontroller manufactured by Motorola. In a preferred embodiment, the controller 21 is a single board computer, for example, the QSCREEN CONTROLLER sold by MOSAIC INDUSTRIES.

The voltage supply 23 is any means of supplying a voltage across its output and thereby the first winding 25. Preferably, the voltage supply supplies a DC voltage, preferably less than 20 volts for safety, more preferably approximately 12 volts DC. Preferably, the voltage supply 23 is a battery, electricity from the grid, electricity from the grid converted to DC using a DC power converter, rectified electricity from the grid, electricity generated from various means (e.g. solar, wind, geothermal, etc.), etc. Preferably, the voltage supply 23 is capable of reversing the polarity of the voltage, using one or more electrical switches. In one embodiment, a series of relays are used to control the polarity of the voltage supplied by the voltage supply 23. In another embodiment, a series of transistors (e.g. MOSFET, BJT, etc.) are used to control the polarity of the voltage supplied by the voltage supply 23. The voltage produced by the voltage supply 23 is at least large enough to produce an electromagnetic field within the core with enough intensity as to eventually affect the saturation of the core material with magnetic flux. The voltage supply 23 magnitude needed to eventually affect the saturation of the core with magnetic flux is preferably optimized for the various factors, for example, but not limited to, core material, distance from the first winding, first winding material, first winding insulation, core insulation, other electromagnetic fields at the core, etc.

Figure 4:
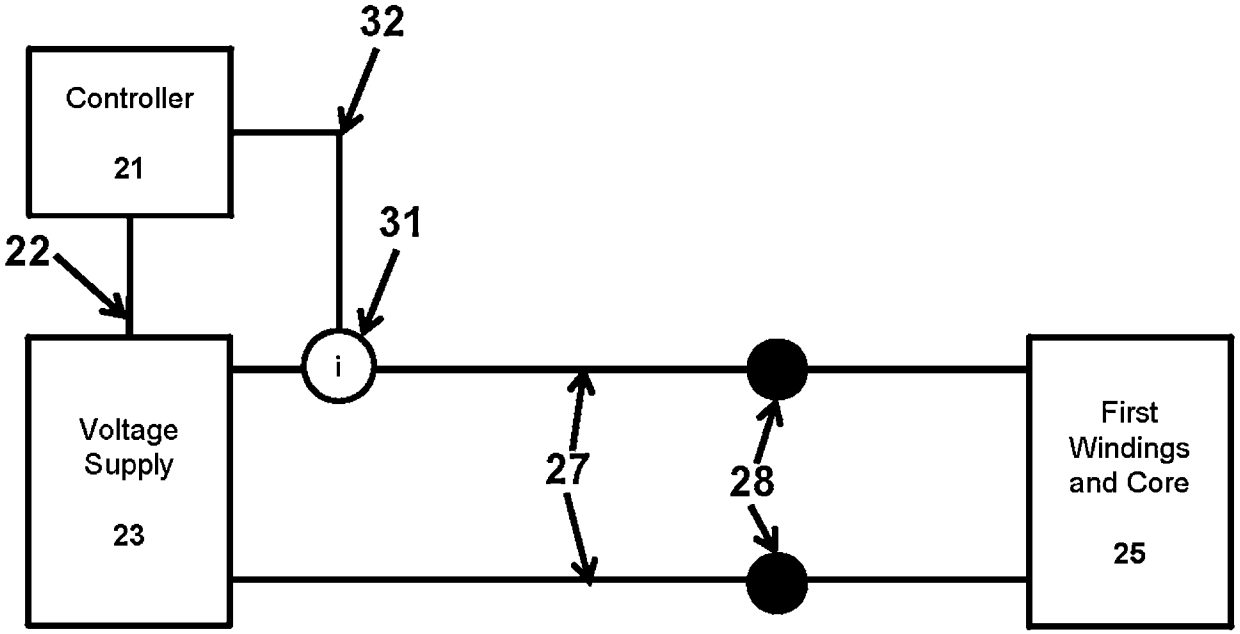
FIG. 4 depicts one embodiment of a device for demagnetizing with the volt meter in FIG. 3 omitted

The volt meter 29 is any means of determining the voltage across the first winding 25. In one embodiment, the volt meter 29 is an ADC (analog-to-digital converter) connected to, or more preferably built into, the controller 21. Preferably, the voltage across the first winding 25 is stepped-down, preferably using a voltage divider, operation amplifier, etc. prior to measurement by an ADC. Preferably, the volt meter 29 is included to allow for the resistivity determination using Ohm's Law for health determination, preferably during demagnetization. In the alternative, the volt meter 29, may be omitted, as shown in FIG. 4. Preferably, the volt meter 29 comprises a 25 bit ADC, preferably at 60 samples per second The current meter 31 is any means of determining the electrical current running through the first winding 25, preferably using one or more shunt resistors, hall effect current sensor transducers, and magnetoresistive field sensors. Preferably, the voltage is stepped-down, preferably using a voltage divider, operation amplifier, etc. In one embodiment, one or more shunt resistors are used, whereby, the current meter 31 is an ADC (Analog-to-digital converter) connected to, or more preferably built into, the controller 21. The electrical current is calculated using Ohm's law using the measured voltage and the known resistance of the electrical components. In an alternate embodiment, a current clamp is used, for example a coil of wire wrapped around one of the wires 27, whereby the current induced in the coil of wire is detected, for example using a resistive load and an ADC (Analog-to-digital-converter).

The first winding electromagnetically connected to a core 25 is any electrical conductor in electromagnetic communications with a core. Preferably, the first winding and core 25 is a metal core surrounded by a first winding, an electrical conductor. In one embodiment, the first winding and core 25 is a power transformer comprising a core, a first winding and a second winding, whereby the first winding and the second winding are wrapped around different sections of the core. The first winding and core 25 are preferably as described in FIG. 5*a* and FIG. 5*b*.

FIG. 4

FIG. 4 depicts one embodiment of a device for demagnetizing with the volt meter 29 in FIG. 3 omitted. This embodiment is as described above for FIG. 3, except that the volt meter 29 in FIG. 3 is omitted and the voltage supply 23 is assumed constant by the controller 21. This embodiment is preferred for embodiments where the voltage supply 23 produces a constant voltage, preferably DC voltage, and preferably with minimal electrical resistance between the voltage supply 23 and the first winding 25. Therefore, in this embodiment, the known, constant voltage supplied by the voltage supply 23 is assumed to be the voltage across the first winding 25.

Figure 5B:
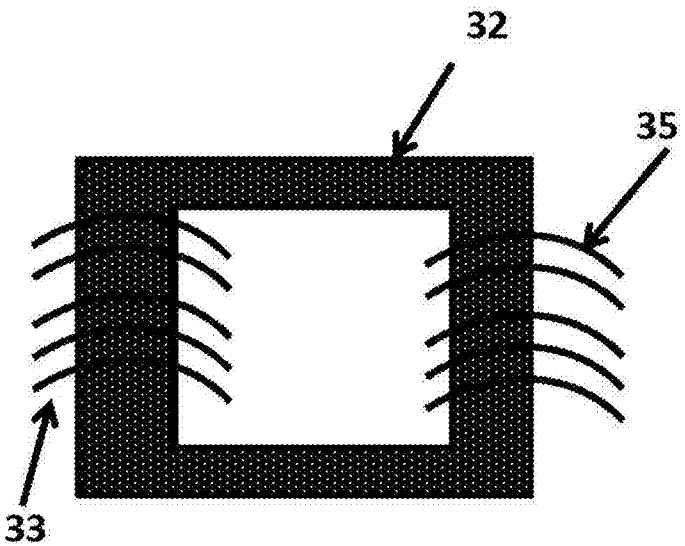
FIG. 5*b* depicts a side view of one embodiment of a core with a first winding and a second winding, preferably used as a transformer.
Figure 5A:
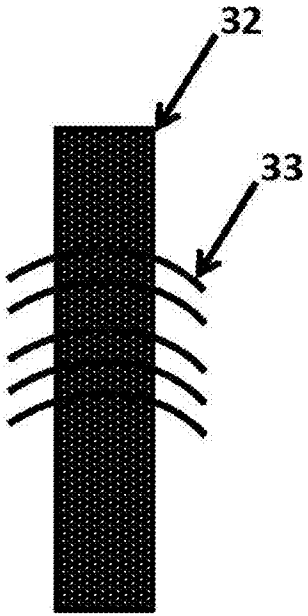
FIG. 5*a* depicts a side view of one embodiment of a core with a first winding.

FIG. 5*a* and FIG. 5*b*

FIG. 5*a* depicts a side view of one embodiment of a core 32 with a first winding 33. As shown the first winding 33, is an electrical conductor wrapped around the core 32. As a first voltage is applied across the first winding 33, the induced first electrical current generates an electromagnetic field within the core 32.

FIG. 5*b* depicts a side view of one embodiment of a core 32 with a first winding 33 and a second winding 35, preferably used as a transformer. As shown, the first winding 33, is an electrical conductor wrapped around the core 32. As a first voltage is applied across the first winding 33, the induced first electrical current generates an electromagnetic field within the core 32. The second winding 35, is an electrical conductor wrapped around the core 32, at a different location, but within the same core 32, whereby an electrical current is induced within the second winding 35 in response to the electromagnetic field generated by current flowing through the first winding 33. Preferably, during demagnetization, the second winding 35 is electrically shorted, whereby the second winding 35 is an electrical conductor wrapped around the core and electrically connected at both ends.

The core is any material capable of magnetization and subsequent demagnetization by application of an electromagnetic field. Preferably, the core is a metal core of a transformer. More preferably, the core is the metal core of a power transformer surrounded by the first winding, and used for power distribution.

The first winding is any electrical conductor, whereby a magnetic field is generated upon application of the first voltage across the first winding. Preferably, the first winding is an electrical conductor wrapped around the core, more preferably an inductor or more preferably, a transformer. Preferably, the first winding is the electrical conductor winding of a power transformer used for power distribution.

FIG. 6

Figure 6:
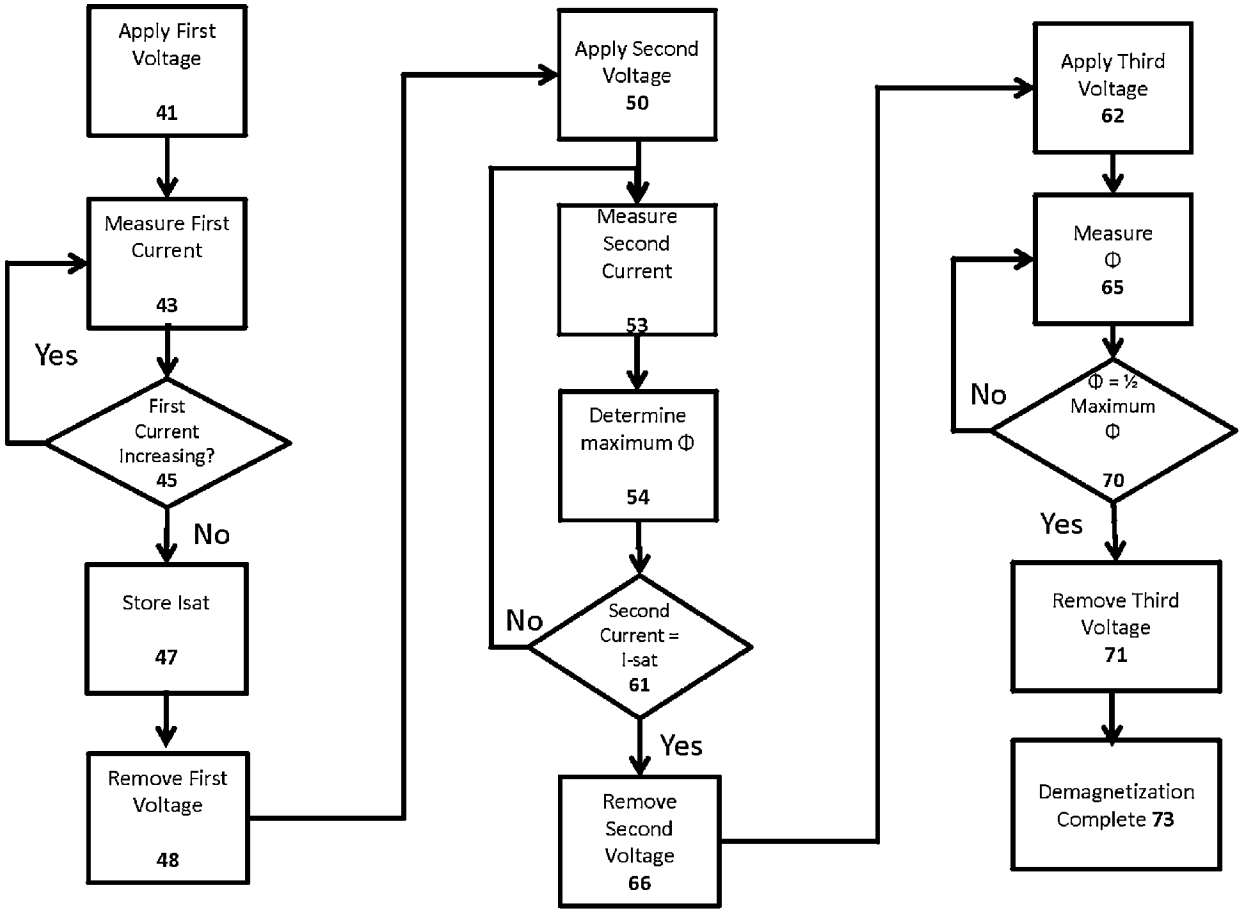
FIG. 6 depicts one embodiment of a method for demagnetizing a core.

FIG. 6 depicts one embodiment of a method for demagnetizing a core, preferably performed by the controller 21 in FIG. 3 described above. A core, preferably as shown in FIG. 5*a* or FIG. 5*b*, is provided. As discussed above, the core is positioned within the electromagnetic field generated by a first winding up application of a first voltage across the first winding. A first voltage is applied 41 across the first winding generating a first electrical current. The first electrical current is measured 43. If the first current is substantially increasing, then the first current is again measured 43, while the first voltage continues to be applied 41. Once the first current is no longer substantially increasing 45, the last measured first current is stored determining a saturation current ($I_{sat}$) 47. In a preferred embodiment, the step of storing the saturation current ($I_{sat}$) 47 is done in parallel with one or more other steps.

The various steps are preferably performed by a device similar to FIG. 3 or FIG. 4. Preferably, the controller 21, or any other device capable of performing the method in FIG. 6 with the necessary hardware, is used to perform the steps listed in FIG. 6. Preferably, the first electrical current is measured 43 using a current meter 31, or any other device capable of measuring electrical current. Preferably, the controller 21 or any other device capable of performing mathematical operations is used to determine whether the first current is no longer substantially increasing 45. Preferably, the controller 21, or any other device capable of storing data is used to store the last measured first current determining a saturation current ($I_{sat}$) 47

Once the saturation current ($I_{sat}$) is determined in step 47, the first voltage is removed 48 and the second voltage is applied to the first winding 50. The second voltage has the reversed polarity of the first voltage. The second electrical current is measured 53, while the second voltage continues to be applied 50. The measured second current is then used, preferably by a processor, to determine a value related to the maximum magnetic flux (ϕ) 54. Once the second current is approximately equal to the saturation current 61, then the process continues to step 62. The continued application of the second voltage after a value related to the maximum magnetic flux (ϕ) 54 is determined is required to ensure that the core is placed in a known, saturated, state.

The various steps are preferably performed by a device similar to FIG. 3 or FIG. 4. Preferably, the second electrical current is measured 53 using a current meter 31, or any other device capable of measuring electrical current. Preferably, the controller 21 or any other device capable of performing mathematical operations is used to determine the maximum magnetic flux (ϕ) 54. Preferably, the controller 21, or any other device capable of performing mathematical operations is used to determine whether the second current is approximately equal to the saturation current 61.

Once the second current is approximately equal to the saturation current 61, the second voltage is removed 66 and a third voltage is applied 62. The third voltage has the reversed polarity of the second voltage. The value related to magnetic flux (ϕ) within the core is measured 65. In step 70, the process continues with the application of the third voltage 62 until the measured value related to magnetic flux (ϕ) within the core 65 reaches the determined value related to the maximum value related to the magnetic flux (ϕ) 54. In step 70, once the measured value related to magnetic flux (ϕ) within the core 65 reaches the determined value related to the maximum value related to the magnetic flux (ϕ) 54, the third voltage 71 is removed. After the third voltage is removed 71, the core is left in a demagnetized state thereby completing demagnetization 73.

The various steps are preferably performed by a device similar to FIG. 3 or FIG. 4. Preferably, the controller 21, or any other device capable of performing mathematical operations is used to determine measured value related to magnetic flux (ϕ) within the core 65. Preferably, the controller 21, or any other device capable of performing mathematical operations, is used to determine measured value related to magnetic flux (ϕ) within the core 65 reaches the determined value related to the maximum value related to the magnetic flux (ϕ) 54 of step 70.

Applying a First Voltage 41

A first voltage is applied across the first winding generating a first electrical current through the first winding. The first voltage is applied, preferably using the voltage supply 23 in FIG. 3 described above, across a first winding generating a first electrical current through the first winding until the generated first electrical current is not substantially increasing thereby determining a saturation current. Due to the inductance of the first winding, the first electrical current in response to the applied first voltage will not have an instantaneous response, but rather a diminishing increase into a stable first electrical current. Preferably, once the first electrical current is no longer increasing approximately along a linear curve it is considered as no longer substantially increasing. In one embodiment, if the first electrical current is no longer increasing by at least 10% per second, it is considered as no longer substantially increasing. The determined saturation current is then the first electrical current that substantially saturates the core.

Determine the Maximum Value Related to Magnetic Flux (ϕ) 54

The value related to maximum magnetic flux (ϕ) 54 may be determined using a variety of techniques. Preferably, the flux linkage (Volt*Seconds) of the first winding is used to estimate the value related to magnetic flux (ϕ) within the core, as discussed above. In a preferred embodiment of using the flux linkage of the first winding to estimate the value related to magnetic flux within the core, the step of determining a value related to the maximum value related to magnetic flux within the core comprises measuring the electrical current through the first winding during the application of the second voltage 50 and calculating a value related to the integral of the voltage across the first winding with respect to time minus a value related to the integral of the product of the winding resistance and the electrical current through the first winding with respect to time, thereby determining a value related to the maximum value related to magnetic flux. In a preferred embodiment, the voltage across the first winding during the application of the second voltage is measured directly using a volt meter. In an alternative embodiment, the voltage across the first winding is determined from the second voltage, more preferably is the second voltage. Preferably, the value related to an integral, either precisely calculated precisely or including various mathematical estimations, simplifications, approximations, or combinations thereof. Preferably, all calculations are performed by a processor, for example a CPU (Central Processing Unit), microcontroller, ASIC (Application Specific Integrated Circuit) or combination thereof.

Figure 7:
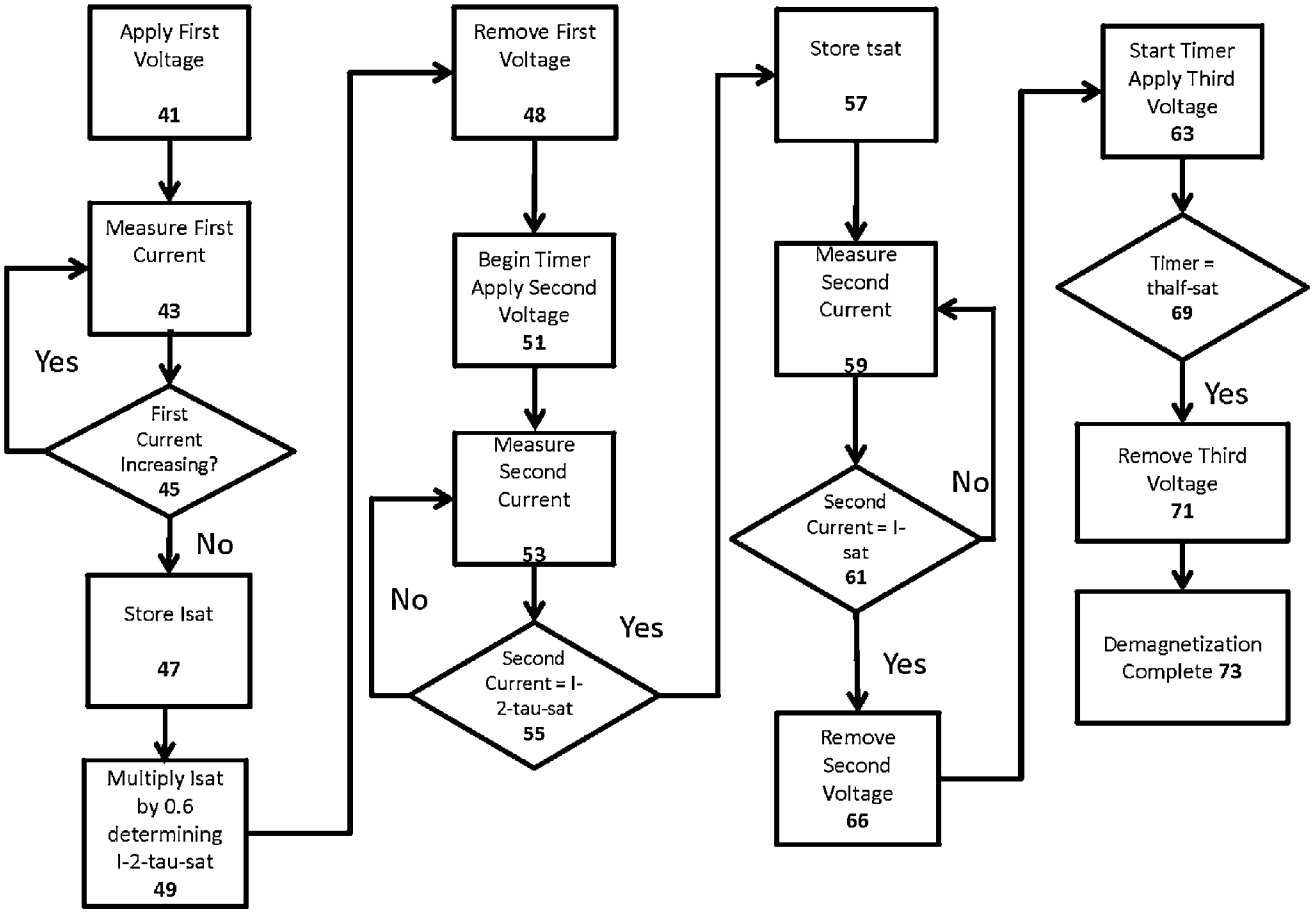
FIG. 7 depicts one embodiment of a method for demagnetizing a core using a preferred embodiment for determining a value related to the maximum magnetic flux within the core optimized for the simplification of calculations.

In a preferred embodiment, shown in FIG. 7, the step of determining a value related to the maximum value related to magnetic flux within the core comprises multiplying the determined saturation current by approximately 0.6, more preferably 0.632, determining a two-tau saturation current, for example as shown in FIG. 7. In this embodiment, during the step of applying a second voltage across the first winding, the amount of time for the second electrical current to reach the approximate magnitude of the two-tau saturation current is timed, thereby determining the saturation time. The half saturation time is determined by dividing the timed two-tau saturation time by two. Preferably, all calculations are performed by a processor, for example CPU (Central Processing Unit), microcontroller, ASIC (Application Specific Integrated Circuit) or combination thereof.

Applying a Second Voltage 50

After the step of applying a first voltage across the first winding 41 and determining the saturation current 47, the first voltage is removed 48 and a second voltage is applied across the first winding 41 generating a second electrical current through the first winding. The second electrical current is applied until the generated second electrical current is approximately equal to the saturation current 61. The second voltage has the same magnitude, but reversed polarity of the first voltage, for example providing 10V instead of −10V or vice-versa.

The second voltage is applied, preferably using the voltage supply 23 in FIG. 3 described above, across a first winding generating a second electrical current through the first winding until the generated second electrical current is substantially equal to the saturation current. Preferably, once the second electrical current is within 10%, more preferably 5% of the magnitude of the saturation current it is considered as approximately equal. The second electrical current is in the opposite direction of the first electrical current. In one embodiment, once the second electrical current is within 1% of the magnitude of the saturation current it is considered approximately equal. Application of the second voltage across the first winding 62 allows for the determination of the value related to maximum magnetic flux (ϕ) 54 and also puts the transformer in a known state, saturated by the electromagnetic field generated by the first winding from the second electrical current.

Applying a Third Voltage

After the step of applying a second voltage across the first winding 50, the second voltage is removed 66 and a third voltage is applied across the first winding 62 generating a third electrical current through the first winding. In step 70, the third electrical current is applied until measured value related to magnetic flux (ϕ) within the core 65 reaches half the determined maximum value related to magnetic flux (ϕ) 54. The third voltage has the reversed polarity of the second voltage. Preferably, the third voltage has the same magnitude, but reversed polarity of the second voltage, for example providing 10V instead of −10V or vice-versa. In an alternate embodiment, a variable voltage is applied having a voltage polarity opposite of the first voltage, for example a square wave (not crossing zero), sinusoidal wave, etc. Preferably, the third voltage is applied using the voltage supply 23 in FIG. 3 as described above. After the core saturation time, the third voltage is removed from the first winding, thereby leaving the core in a demagnetized state.

The Measured Value Related to Magnetic Flux (ϕ) within the Core 65 Reaches the Determined Maximum Value Related to Magnetic Flux (ϕ) 70

In step 70, the process continues with the application of the third voltage 62 until the measured value related to magnetic flux (ϕ) within the core 65 reaches the maximum value related to magnetic flux (ϕ) determined in step 54. In step 70, once the measured value related to magnetic flux (ϕ) within the core 65 reaches the determined maximum value related to magnetic flux (ϕ) 54, the third voltage 71 is removed, leaving the core demagnetized 73.

The value related to magnetic flux (ϕ) within the core may be measured 65 using a variety of techniques. Preferably, the technique used to measure the value related to magnetic flux (ϕ) within the core 65 is the same as the technique used to determine the maximum value related to magnetic flux (ϕ) 70. In one embodiment, the step of applying a third voltage across the first winding comprises calculating a value related to the integral of the voltage across the first winding with respect to time minus a value related to the integral of the product of the winding resistance and the electrical current through the first winding with respect to time, thereby determining a value related to the magnetic flux of the core. In a preferred embodiment, the voltage across the first winding during the application of the third voltage is measured directly using a volt meter. In an alternative embodiment, the voltage across the first winding is determined from the third voltage, more preferably is the third voltage. Preferably, the value related to an integral, either precisely calculated precisely or including various mathematical estimations, simplifications, approximations, or combinations thereof. Preferably, all calculations are performed by a processor, for example CPU (Central Processing Unit), microcontroller, ASIC (Application Specific Integrated Circuit) or combination thereof.

In a preferred embodiment, shown in FIG. 7, the step of determining a value related to the maximum value related to magnetic flux within the core comprises multiplying the determined saturation current by approximately 0.6, more preferably 0.632, determining a two-tau saturation current, for example as shown in FIG. 7. In this embodiment, the third voltage is applied across the first winding for the determined half saturation time. Preferably, all calculations are performed by a processor, for example CPU (Central Processing Unit), microcontroller, ASIC (Application Specific Integrated Circuit) or combination thereof.

FIG. 7

FIG. 7 depicts one embodiment of a method for demagnetizing a core using a preferred embodiment for determining a value related to the maximum value related to magnetic flux within the core optimized for the simplification of calculations, preferably performed by the controller 21 in FIG. 3 described above. A core, preferably as shown in FIG. 5*a* or FIG. 5*b*, is provided. As discussed above, the core is positioned within the electromagnetic field generated by a first winding upon application of a first voltage across the first winding. A first voltage is applied 41 across the first winding generating a first electrical current. The first electrical current is measured 43. If the first current is substantially increasing, then the first current is again measured 43, while the first voltage continues to be applied 41. Once the first current is no longer substantially increasing 45, the last measured first current is stored determining a saturation current ($I_{sat}$) 47.

The determined saturation current is then multiplied by approximately 0.6, more preferably 0.632 determining a two-tau saturation current ($I_{2\text{-}tau\text{-}sat}$) 49. In an alternative embodiment, the storage of the saturation current 47, the determination of two-tau saturation current 49, or a combination thereof may be done in parallel with any of the steps until it is used in step 55.

Next, the first voltage is removed 48 and a timer is started and a second voltage is applied across the first winding generating a second electrical current through the first winding 51. The second voltage has the same magnitude, but reversed polarity of the first voltage. The second electrical current is measured 53, while the second voltage continues to be applied 51. In step 55, if the second current is not approximately equal to the two-tau saturation current determined in step 49, then the second current is again measured 53. Once the second is current is approximately equal to or greater than the two-tau saturation current determined in step 49, then, the value of the timer divided by two is stored thereby determining the core saturation time ($t_{sat}$) 57. The saturation time ($t_{sat}$) is determined by the amount of time for the second current to reach the magnitude of the two-tau saturation current. A core saturation time is determined by dividing the two-tau saturation time by two. In an alternate embodiment, the actual calculation of the core saturation time ($t_{sat}$) may be done at any time before it is used in step 69. Therefore, steps 55, and 57, along with the timing introduced in step 51 performs for the function of determining maximum value related to magnetic flux (ϕ) 54 in FIG. 6.

Next, the second current is measured 59 again. If the second current is not approximately equal to the saturation current 61, then the second current is measured 59, while the second voltage continues to be applied 51. If the second current is approximately equal to the saturation current 61, then the process continues to step 63. The continued application of the second voltage is required to ensure that the core is in placed in a known, saturated, state.

Next, the second voltage is removed 66 and a timer, preferably the same time in step 51 reset, is started and a third voltage is applied across the first winding 63. The third voltage creates a third electrical current through the first winding. The third voltage has the same magnitude and polarity as the first voltage, reversed polarity of the second voltage. If the timer started in step 63 has not reached the core saturation time ($t_{sat}$) 69, the third voltage continues to be applied 63. If the timer started in step 63 has reached the core saturation time 69, the third voltage is removed 71 resulting in a completed demagnetization 73. Therefore, steps 69, along with the timing introduced in step 61 performs for the function of determining when the measured value related to magnetic flux (ϕ) within the core 65 reaches the determined maximum value related to magnetic flux (ϕ) 54 in FIG. 6.

Due to timing, the controller may miss the point at which the first measured current, second measured current, the timer, or a combination thereof reach a particular value. Preferably, the controller is designed to account for this and accept currents or time not only equal to, but afterwards to compensate for the given timing frequency.

Multiplying the Determined Saturation Current

Once the saturation current is determined, the two-tau saturation current is determined by multiplying the saturation current by 0.6, preferably 0.63, more preferably 0.632. Preferably, this is done using a processor, for example microcontroller, CPU (Central Processing Unit), or ASIC (Application Specific Integrated Circuit), more preferably the controller 21 in FIG. 3 as described above.

Timing the Amount of Time for Second Current to Reach the Magnitude of the Two-Tau Saturation Current During the step of applying a second voltage across the first winding, the amount of time for the second current to reach the magnitude of the two-tau saturation current is timed, thereby determining a saturation time. Preferably, once the second electrical current is within 10%, more preferably 5% of the two-tau saturation current, it is considered approximate to the two-tau saturation current. In one embodiment, once the second electrical current is within 1% of the two-tau saturation current it is considered approximate to the two-tau saturation current.

The various steps are preferably performed by a device similar to FIG. 3 or FIG. 4. Preferably, the controller 21, or any other device capable of performing mathematical operations is used to perform the various mathematical calculations described above.

Determining Core Saturation Time

Once the two-tau saturation time is determined, the core saturation time is determined by dividing the two-tau saturation time by two (2). Preferably, this is done using a processor, for example microcontroller, CPU (Central Processing Unit), or ASIC (Application Specific Integrated Circuit), more preferably using the controller 21 in FIG. 3 as described above.

Health Characteristics

Preferably, one or more health characteristics are determined for the core using various techniques. Preferably, at least one health characteristic determined for the core is resistance testing, whereby a DC current is applied across a winding of the core. In a preferred embodiment, after the saturation current is determined, step 47 in FIG. 6, the resistance across the winding is determined using Ohm's law by dividing the first voltage by the first electrical current. In an alternate embodiment, the resistance across the winding is determined using Ohm's law by dividing the measured voltage across the first winding, preferably using a volt meter as shown in FIG. 3, by the first electrical current. Once the electrical current has stabilized, the resistance across the first winding is calculated using Ohm's law, given the applied voltage and determined saturation current. The resistance across the first winding is then correlated with a known dataset of corresponding to the core to determine one or more health characteristics of the core. IEEE 62-1995, hereby fully incorporated by reference, describes in more details a resistance testing to determine health characteristics of a core is a preferred embodiment.

FIG. 8

Figure 8:
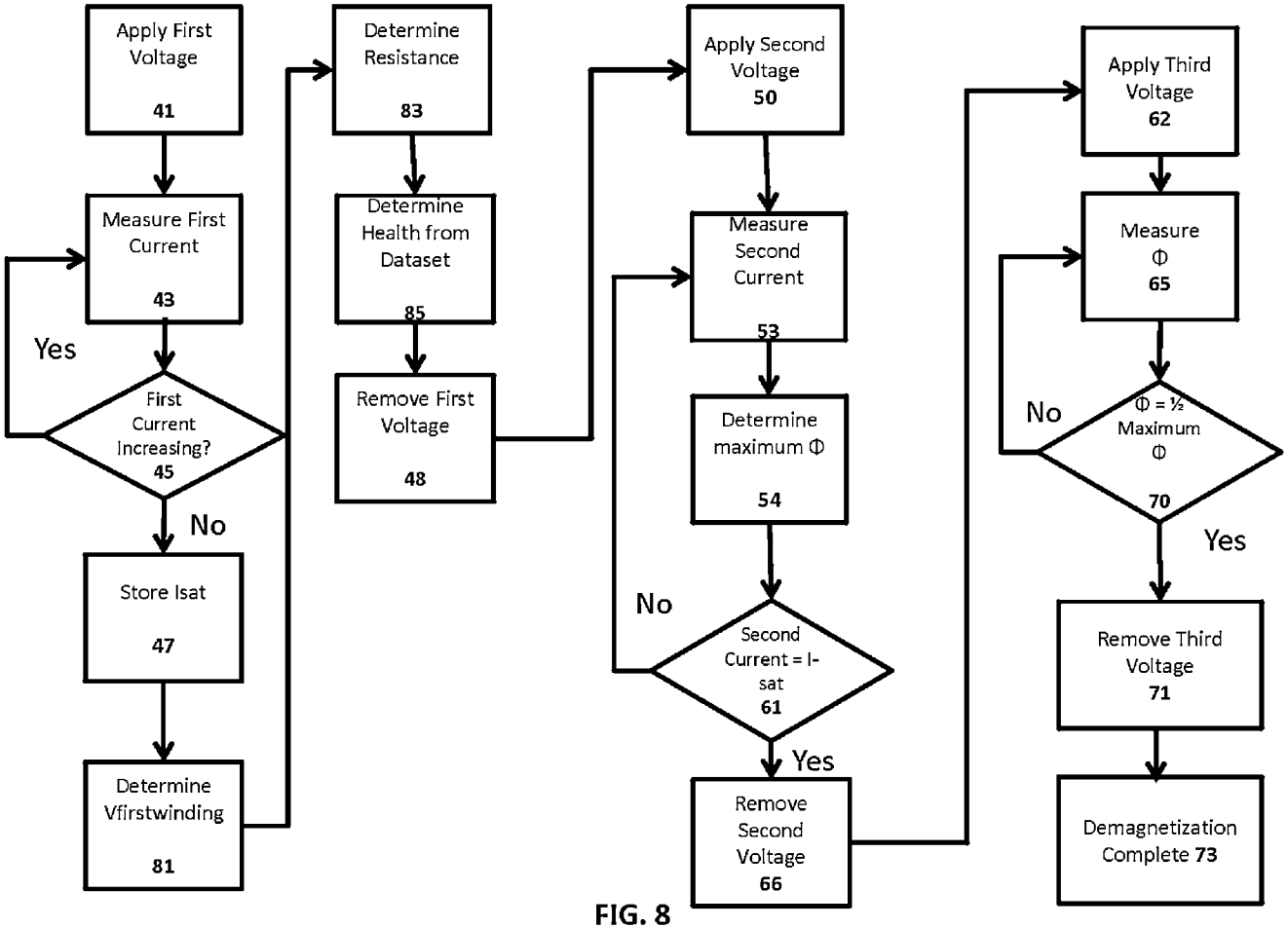
FIG. 8 depicts one preferred embodiment of a method for determining one or more health characteristics of a core and demagnetizing the core.

FIG. 8 depicts one preferred embodiment of a method for determining one or more health characteristics of a core and demagnetizing the core. As shown, the process is identical to the process described above for FIG. 6. As shown in FIG. 8, the saturation current ($I_{sat}$) is stored 47 and the process continues with measuring the voltage across the first winding ($V_{firstwinding}$) 81, determining the resistance of the first winding 83 and then determining the health of the core using a known dataset 85. Once the saturation current ($I_{sat}$) and the voltage across the first winding ($V_{firstwinding}$) is determined, the resistance of the first winding 83 and then the health of the core using a known dataset 85 may be determined anytime. The resistance of the first winding is preferably determined as described above, preferably using Ohm's law by dividing the voltage (during core saturation) across the first winding by the saturation current (Isat). The health of the core is determined using a known dataset 85 by correlating the resistance across the first winding with a known dataset of corresponding to the core to determine one or more health characteristics of the core. IEEE 62-1995, hereby fully incorporated by reference, describes in more details a resistance testing to determine health characteristics of a transformer is a preferred embodiment.

The various steps are preferably performed by a device similar to FIG. 3 or FIG. 4. Preferably, the controller 21, or any other device capable of performing mathematical operations is used to perform the various mathematical calculations described above.

Three Phase

Demagnetizing single phase transformers with this method is very efficient and straightforward. The same method may be used on three phase transformers by simply performing two demagnetization steps with different phases shorted each time.

Alternate Embodiments

In one embodiment, the method can be simplified by estimating the standard operating flux linkage from the voltage class of the transformer at 60 Hz instead of determining the two-tau saturation time as described above. From that result, for a small loss of accuracy in demagnetization, tau ($\tau$) can be derived from the voltage rating of the transformer. This would further reduce the time necessary to demagnetize a transformer since the flux linkage characterization cycle would be unnecessary. In another embodiment, the two-tau saturation time is determined for a transformer type and used for multiple subsequent tests of transformers of the same type.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

All publications and patent documents cited in this application are incorporated by reference in their entirety for all purposes to the same extent as if each individual publication or patent document were so individually denoted.

Any element in a claim that does not explicitly state "means for" performing a specified function, or "step for" performing a specific function, is not to be interpreted as a "means" or "step" clause as specified in 35 U.S.C.§112, ¶6. In particular, the use of "step of" in the claims herein is not intended to invoke the provisions of 35 U.S.C.§112, ¶6.

The invention claimed is:

1. A method for demagnetizing comprising:

a. providing a core positioned within the electromagnetic field generated by a first winding upon application of a first voltage across said first winding;

b. applying said first voltage across said first winding generating a first electrical current through said first winding until said generated first electrical current is not substantially increasing, thereby determining a saturation current;

c. after said step of applying said first voltage across said first winding, applying a second voltage across said first winding generating a second electrical current through said first winding until said generated second electrical current is approximately equal to the magnitude of said determined saturation current; the polarity of said second voltage opposite of the polarity of said first voltage;

d. determining, using a processor, a value related to the maximum magnetic flux within said core during said step of applying a second voltage across said first winding using a value relating to the voltage across said first winding and a value relating to said second current;

e. after said step of applying a second voltage across said first winding, applying a third voltage across said first winding generating a third electrical current through said first winding until said core has a value related to the magnetic flux of the core, the same relation as said determined value related to the maximum magnetic flux, approximately half of said determined value related to the maximum magnetic flux within said core; the polarity of said third voltage opposite of the polarity of said second voltage, thereby demagnetizing said core;

f. said step of applying a second voltage across said first winding comprises applying a second voltage across said first winding; said second voltage having a magnitude equal to the magnitude of the first voltage;

g. said step of determining the a value related to the maximum magnetic flux within said core comprises:

i. multiplying said determined saturation current by approximately 0.6 determining a two-tau saturation current; and ii. during said step of applying a second voltage across said first winding, timing the amount of time for said second electrical current to reach the approximate magnitude of said two-tau saturation current thereby determining a saturation time; and h. said step applying a third voltage across said first winding comprising:

i. determining a half saturation time by dividing said timed two-tau saturation time by two; and ii. applying said third voltage across said first winding for said half saturation time.

2. The method for demagnetizing of claim 1 further comprising:

a. said step of multiplying said determined saturation current by approximately 0.6 determining a two-tau saturation current comprises multiplying said determined saturation current by approximately 0.632 determining a two-tau saturation current.

3. The method for demagnetizing of claim 2 further comprising:

a. determining the electrical resistance across said first winding by dividing said first applied voltage by said first electrical current; and b. comparing said determined electrical resistance to a known dataset of corresponding to said transformer to determine one or more health characteristics of said transformer.

4. The method for demagnetizing of claim 2 further comprising:

a. during said step of applying said first voltage across said first winding, determining the electrical resistance across said first winding by dividing the voltage across the first winding by said first electrical current;

b. comparing said determined electrical resistance to a known dataset of corresponding to said core to determine one or more health characteristics of said core; and whereby c. said provided core further comprises a second winding electrically shorted; and d. said provided core comprises a network transformer.

5. The method for demagnetizing of claim 4 whereby:

a. said provided core comprises a three-phase network transformer; and b. said processor comprises a CPU (Central Processing Unit), microcontroller ASIC (Application Specific Integrated Circuit), or a combination thereof.

6. The method for demagnetizing of claim 5 further comprising:

a. said step of multiplying said determined saturation current by approximately 0.6 determining a two-tau saturation current comprises multiplying said determined saturation current by approximately 0.632 determining a two-tau saturation current.

7. A method for demagnetizing comprising:

a. providing a core positioned within the electromagnetic field generated by a first winding upon application of a first voltage across said first winding;

b. applying said first voltage across said first winding generating a first electrical current through said first winding until said generated first electrical current is not substantially increasing, thereby determining a saturation current;

c. after said step of applying said first voltage across said first winding, applying a second voltage across said first winding generating a second electrical current through said first winding until said generated second electrical current is approximately equal to the magnitude of said determined saturation current; the polarity of said second voltage opposite of the polarity of said first voltage;

d. determining, using a processor, a value related to the maximum magnetic flux within said core during said step of applying a second voltage across said first winding using a value relating to the voltage across said first winding and a value relating to said second current;

e. after said step of applying a second voltage across said first winding, applying a third voltage across said first winding generating a third electrical current through said first winding until said core has a value related to the magnetic flux of the core, the same relation as said determined value related to the maximum magnetic flux, approximately half of said determined value related to the maximum magnetic flux within said core; the polarity of said third voltage opposite of the polarity of said second voltage, thereby demagnetizing said core;

f. determining the electrical resistance across said first winding by dividing said first applied voltage by said first electrical current; and g. comparing said determined electrical resistance to a known dataset of corresponding to said transformer to determine one or more health characteristics of said transformer.

8. The method for demagnetizing of claim 7 whereby:

a. said step of determining a value related to the maximum magnetic flux within said core comprises:

i. measuring the electrical current through said first winding during said application of said second voltage; and ii. calculating a value related to the integral of the voltage across said first winding with respect to time minus a value related to the integral of the product of the winding resistance and the electrical current through the first winding with respect to time, thereby determining a value related to the maximum magnetic flux; and b. said step applying a third voltage across said first winding comprises:

i. calculating a value related to the integral of the voltage across said first winding with respect to time minus a value related to the integral of the product of the winding resistance and the electrical current through the first winding with respect to time, thereby determining a value related to the magnetic flux of said core.

9. The method for demagnetizing of claim 8 further comprising:

a. measuring the voltage across said first winding during said application of said second voltage; and whereby b. said step of calculating a value related to the integral of the voltage across said first winding with respect to time comprises calculating a value related to the integral of said measured voltage across said first winding with respect to time.

10. The method for demagnetizing of claim 8 whereby:

a. said step of applying a second voltage comprises applying a second voltage having a predetermined constant second voltage output; and b. said step of calculating a value related to the integral of the voltage across said first winding with respect to time comprises calculating a value related to the integral of said predetermined constant second voltage output with respect to time.

11. A method for demagnetizing comprising:

a. providing a core positioned within the electromagnetic field generated by a first winding upon application of a first voltage across said first winding;

b. applying said first voltage across said first winding generating a first electrical current through said first winding until said generated first electrical current is not substantially increasing, thereby determining a saturation current;

c. after said step of applying said first voltage across said first winding, applying a second voltage across said first winding generating a second electrical current through said first winding until said generated second electrical current is approximately equal to the magnitude of said determined saturation current; the polarity of said second voltage opposite of the polarity of said first voltage;

d. determining, using a processor, a value related to the maximum magnetic flux within said core during said step of applying a second voltage across said first winding using a value relating to the voltage across said first winding and a value relating to said second current;

e. after said step of applying a second voltage across said first winding, applying a third voltage across said first winding generating a third electrical current through said first winding until said core has a value related to the magnetic flux of the core, the same relation as said determined value related to the maximum magnetic flux, approximately half of said determined value related to the maximum magnetic flux within said core; the polarity of said third voltage opposite of the polarity of said second voltage, thereby demagnetizing said core;

f. during said step of applying said first voltage across said first winding, determining the electrical resistance across said first winding by dividing the voltage across the first winding by said first electrical current; and g. comparing said determined electrical resistance to a known dataset of corresponding to said core to determine one or more health characteristics of said core.

12. The method for demagnetizing of claim 11 further comprising:

a. measuring the first voltage across said first winding; and whereby b. said step of determining the electrical resistance across said first winding by dividing the voltage across the first winding by said first electrical current comprises determining the electrical resistance across said first winding by dividing said measured first voltage across the first winding by said first electrical current.

13. The method for demagnetizing of claim 11 further whereby:

a. said step of determining the electrical resistance across said first winding by dividing the voltage across the first winding by said first electrical current comprises determining the electrical resistance across said first winding by dividing said first voltage by said first electrical current.

14. The method for demagnetizing of claim 11 whereby:

a. said step of determining a value related to the maximum magnetic flux within said core comprises:

i. measuring the electrical current through said first winding during said application of said second voltage; and ii. calculating a value related to the integral of the voltage across said first winding with respect to time minus a value related to the integral of the product of the winding resistance and the electrical current through the first winding with respect to time, thereby determining a value related to the maximum magnetic flux; and b. said step applying a third voltage across said first winding comprises:

i. calculating a value related to the integral of the voltage across said first winding with respect to time minus a value related to the integral of the product of the winding resistance and the electrical current through the first winding with respect to time, thereby determining a value related to the magnetic flux of said core.

15. The method for demagnetizing of claim 14 whereby:

c. said provided core further comprises a second winding electrically shorted; and d. said provided core comprises a network transformer.

16. The method for demagnetizing of claim 14 further comprising:

a. measuring the voltage across said first winding during said application of said second voltage; and whereby b. said step of calculating a value related to the integral of the voltage across said first winding with respect to time comprises calculating a value related to the integral of said measured voltage across said first winding with respect to time.

17. The method for demagnetizing of claim 16 whereby:

c. said provided core further comprises a second winding electrically shorted; and d. said provided core comprises a network transformer.

18. The method for demagnetizing of claim 17 whereby:

a. said provided core comprises a three-phase network transformer; and b. said processor comprises a CPU (Central Processing Unit), microcontroller ASIC (Application Specific Integrated Circuit), or a combination thereof.

19. The method for demagnetizing of claim 14 whereby:

a. said step of applying a second voltage comprises applying a second voltage having a predetermined constant second voltage output; and b. said step of calculating a value related to the integral of the voltage across said first winding with respect to time comprises calculating a value related to the integral of said predetermined constant second voltage output with respect to time.

20. The method for demagnetizing of claim 19 whereby:

c. said provided core further comprises a second winding electrically shorted; and d. said provided core comprises a network transformer.

21. The method for demagnetizing of claim 20 whereby:

a. said provided core comprises a three-phase network transformer; and b. said processor comprises a CPU (Central Processing Unit), microcontroller ASIC (Application Specific Integrated Circuit), or a combination thereof.

* * * * *